US006138331A

United States Patent [19]

Powers

[11] Patent Number: 6,138,331

[45] Date of Patent: Oct. 31, 2000

[54] RELEASE RESISTANT SEAT BELT BUCKLE COVER

[76] Inventor: Diana L. Powers, P.O. Box 78, Lincoln, Mass. 01773

[21] Appl. No.: 09/150,116

[22] Filed: Sep. 9, 1998

[51] Int. Cl.[7] ..... A44B 11/25

[52] U.S. Cl. ..... 24/633; 24/306

[58] Field of Search ..... 24/633–642, 306

[56] References Cited

U.S. PATENT DOCUMENTS

| | | | |
|---|---|---|---|
| D. 337,075 | 7/1993 | Powell | D11/200 |
| D. 358,246 | 5/1995 | Bacchiocchi | D2/639 |
| 4,741,574 | 5/1988 | Wrightman et al. | 297/482 |
| 4,901,407 | 2/1990 | Pamdola et al. | 24/633 |
| 4,939,824 | 7/1990 | Reed | 24/633 |
| 4,944,530 | 7/1990 | Spurrier | 280/801 |
| 4,961,251 | 10/1990 | Smith | 24/633 |
| 5,052,087 | 10/1991 | Portuese | 24/633 |
| 5,129,129 | 7/1992 | Collins et al. | 24/633 |
| 5,189,767 | 3/1993 | Reitsma | 24/533 |
| 5,307,544 | 5/1994 | Quarberg et al. | 24/633 |
| 5,442,840 | 8/1995 | Ewald | 24/633 |
| 5,617,617 | 4/1997 | Gustin | 24/633 |

FOREIGN PATENT DOCUMENTS

| | | | |
|---|---|---|---|
| WO 84/01275 | 4/1984 | WIPO | 24/633 |

*Primary Examiner*—James R. Brittain
*Attorney, Agent, or Firm*—Ronald R. Kilponen

[57] ABSTRACT

A release resistant seat belt buckle cover is shown having a first side and second side for wrapping around a female buckle portion. A tongue is inserted through a belt slot of the male portion of the seat belt buckle. The tongue is then threaded through at least one loop as the male and female buckles are joined. The tongue is then attached to the buckle cover thereby discouraging access to the release button and discouraging untimely release of the seat belt buckle.

26 Claims, 7 Drawing Sheets

RELEASE RESISTANT SEAT BELT BUCKLE COVER

FIELD

This invention is related to devices to retain a seat belt buckled.

BACKGROUND

This invention relates to a device for keeping a seat belt buckled such that it cannot be released prematurely by a rider.

Seat belts save lives. Most persons wear seat belts and many states have enacted seat belt laws. Many laws require infant seats and child seats for persons below a specific weight. This device can be used with a seat belt alone or in combination with care seats, booster seats or harnesses used to retain passengers in a vehicle.

The problem addressed is that the belts can be released by bored or curious children or handicapped children and adults. The caretakers may not realize that the seat belt is unbuckled and this could increase the seriousness of injuries if involved in an accident. In the case of handicapped children or adults, the rider is coordinated enough many times to release the belt themselves, but not cognizant of the dangers of releasing the seat belt while riding in a moving vehicle. Other times, the riders may release the seat belt and amble about the moving vehicle or cause harm to other passengers, or interfere with the driver.

It is a serious problem when riders can release the seat belts themselves at inappropriate times. If the driver notices the belt is released they must then stop the vehicle and reattach the belt. This is inconvenient at the least and can require stopping on a busy street or highway posing a hazard to the person who exits the car, if necessary, to reattach the seat belt. If there is another assistant or adult, they must unfasten their belt and lean over the seat or walk back to re-attach the released belt. This is inconvenient, dangerous and time consuming.

When the belt is re-attached, the rider will many times release the belt again requiring attention, to once again re-attach the belt.

Several devices in the art have addressed this issue of retaining the seat belt in the attached position. All the art known addressed retaining seat belts in the attached position for buckles with the release button on the side of the buckle. Many of the newer vehicle seat belts, seat belt recalls and retrofits have the release button on the top of the buckle. While the embodiments disclosed are particularly effective for top release seat belt buckles, they can also be utilized on side release belt buckles. A user could use the device in multiple vehicles or while traveling on vacations in friends or rental vehicles and still deter the release of top or side release buckles.

The prior art is nonfunctional or less functional with buckles having the release button on the top of the buckle. Therefore, if a rider is traveling in a newer vehicle and coordinated enough to release the buckle this many times occurs with no known acceptable cost effective solution. Some of the prior art is made from hard materials such as plastic or metal which could inhibit the release of the seat belt in emergency conditions. This prior art can be hazardous if it is removed during travel and thrown around the vehicle. Other prior art necessitates the use of another object such as a key to release the seat belt. This too can be troublesome in an emergency situation.

The device disclosed herein has been tested on a particularly troublesome handicapped child who was very prone to releasing the seat belt when riding in a vehicle. Other methods and devices failed to retain the child buckled in the seat belt. This device has been successfully used and the child has not been able to remove themself from the seat belt.

For the foregoing reasons, there is a need for a Release Resistant Seat Belt Buckle Cover that will inhibit the release of the seat belt on belts with the release button on the top of the buckle.

In view of the foregoing disadvantages inherent in the prior art, there is a need for a device that will prevent a rider from releasing the seat belt of a top release belt buckle.

OBJECTS OF INVENTION

A first object of the present invention is to provide a device that will inhibit the untimely release of top or side release button seat belts.

A second object of the present invention is to provide a device to prevent the untimely release of top or side release button seat belts.

Another object of the present invention is to provide a device that is not unduly complicated, but prevents the untimely release of the seat belt.

An additional object of the present invention is to provide a device to prevent the release of top or side release button seat belts that is reasonably priced.

Another object of the present invention is to provide a device that is relatively easy to manufacture.

An additional object of the present invention is to provide a device that does not require cumbersome keys or additional tools to release the seat belt.

Another object of the present invention is to provide a device that can and will remain with the buckle when released so that it does not become lost and therefore not used.

It is yet another object of the present invention is to provide a device that will function with the majority of the top and side release button seat belts.

It is a still further object of the present invention is to provide a device that does not require special tooling to manufacture.

Another object of the present invention is to provide a device that is esthetically appealing.

It is yet another object of the present invention to provide a device that can be manufactured from readily available materials.

It is a still further object of the present invention to provide a device that does not require an inordinate amount of time to attach and release from the buckle.

It is an additional object of the present invention to provide a device that is unlikely to wear out.

It is a still further object of the present invention to provide a device that will be unlikely to cause injury to the occupants if it does become detached and is thrown around the interior of the vehicle.

It is another object of the present invention to provide a device that can readily be removed by rescue workers if the vehicle is involved in an accident.

It is an additional object of the present invention to provide a device that does not interfere with the safe operation of the seat belts.

It is a final object of the present invention to provide a device that is easily stored if removed from the seat belt buckle.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

Figure 1:
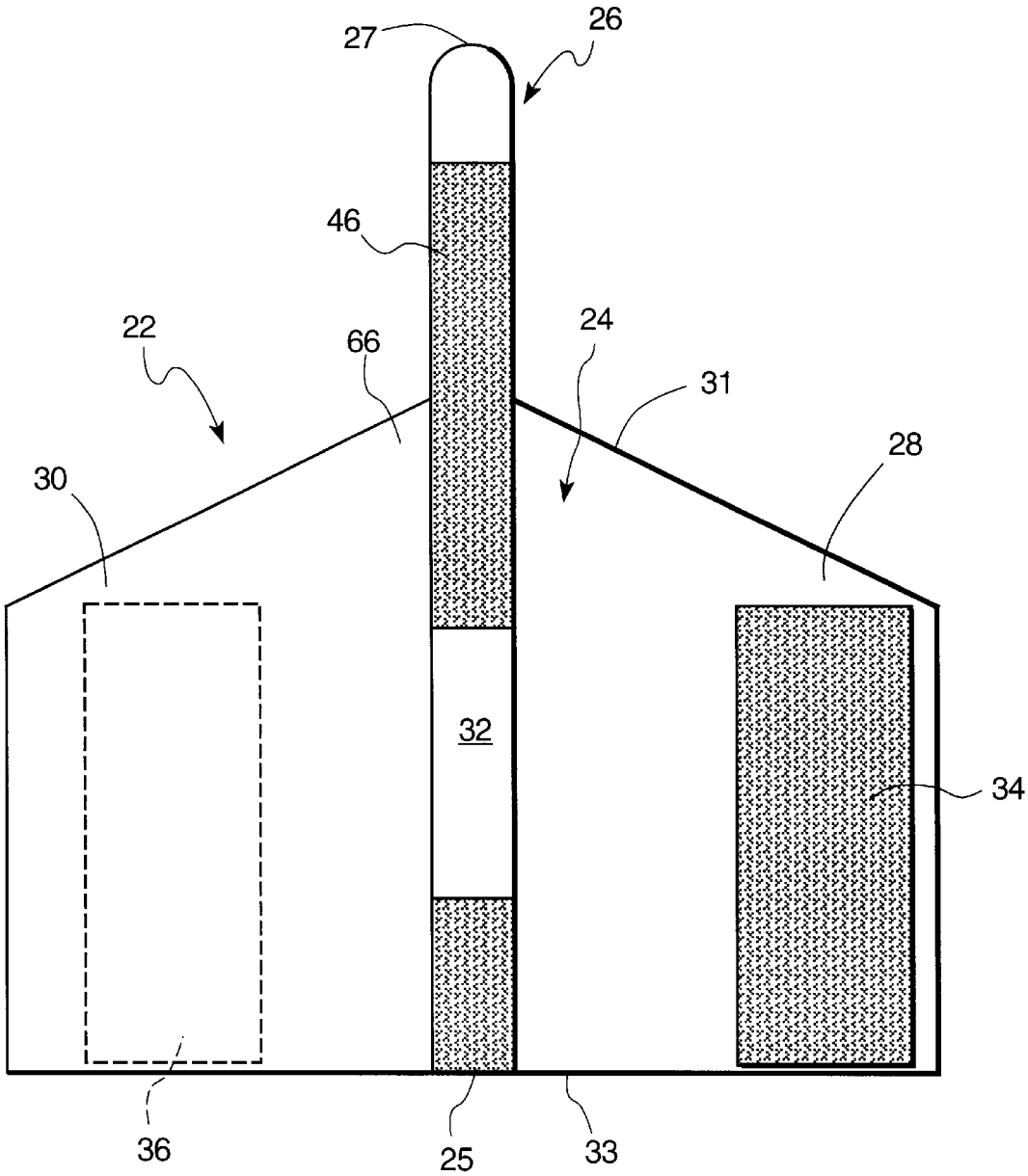
FIG. 1 shows a view of a first embodiment of the inside surface of the present invention.

Referring to the drawings in detail wherein like elements are indicated by like numerals, there is shown in FIG. 1, the inside surface 24 of the buckle cover 22. The buckle cover 22 is manufactured from sheet material that is durable, flexible, tough, aesthetically appealing and resistant to wear such as nylon, vinyl, naugahyde, cotton, cotton-synthetic blends, synthetic materials and imitation leather. Other materials that are readily available and equally easy to work with can also be used. The materials for the buckle cover 22 should also be able to be sewn or stitched and accept a wide variety of adhesives.

The buckle cover 22 has a first side 28, second side 30 and neck 66. Attached to the inside surface 24 on the first side 28 is first fastener 34. The first fastener 34 can be sewn or adhesively attached to the buckle cover 22. This embodiment utilizes hook and loop fasteners for first fastener 34. Other fasteners could be used such as buckles, snaps, grommets and laces, hooks and eyes, buttons with elastic retainers and zippers.

Approximately centrally located on the inside surface 24 is tongue 26. Tongue 26, having a first end 27, extends beyond the neck 66 located at a top edge 31, and terminates in one embodiment, at a second end 25 located near a bottom edge 33. The tongue 26 is made from any strong flexible durable material such as a polymer and is generally of equal thickness to the buckle cover 22 or thinner. The tongue 26 can be sewn or adhesively bonded to the buckle cover 22. A fourth fastener 46 is affixed to the tongue 26. A connector 32, is attached to fourth fastener 46. The fourth fastener 46 can be sewn or adhesively bonded to the buckle cover 22. Connector 32 is used to retain the buckle cover 22 to the female buckle 54 when the buckle cover 22 is released from the female buckle 54. Hook and loop fasteners are shown for the fourth fastener 46 and connector 32. Other equivalent fasteners such as snaps, buckles, ties, grommets and laces, hooks and eyes, buttons with elastic retainers and zippers could be substituted.

Figure 2:
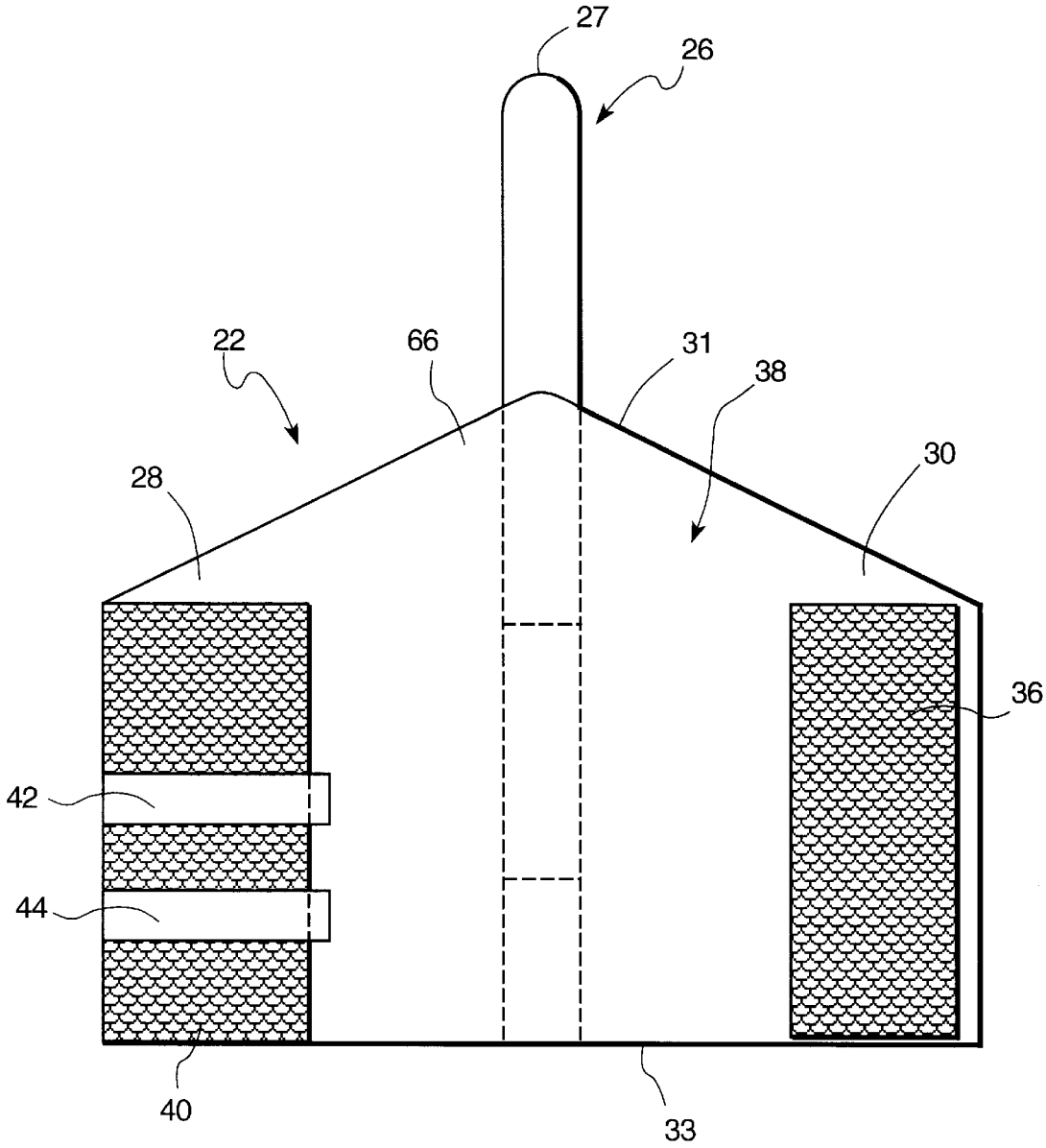
FIG. 2 shows a view of a first embodiment of the outside surface of the present invention.

FIG. 2 shows the outside surface 38 of the buckle cover 22. Affixed to the outside surface 38 is a third fastener 40. Third fastener 40 is shown on the first side 28 as a hook and loop fastener for attachment with the fourth fastener 46 on the tongue 26. Third fastener 40 can be sewn or adhesively bonded to the buckle cover 22. A second fastener 36 is shown on the second side 30 for attachment to the first fastener 34. Second fastener 36 and fourth fastener 40 are shown as hook and loop fasteners and can be attached with adhesive or stitching to the outside surface 38. Other means for attachment could be utilized such as snaps, buckles, ties, grommets and laces, hooks and eyes, buttons with elastic retainers and zippers.

Loops 42, 44 are stitched or attached to the buckle cover 22. Loops 42, 44 are open in between the fixed ends. The loops 42, 44 are made from an elastic material that stretches and returns to the original length. These embodiments show the use of two loops 42, 44, but other configurations could be utilized such as more or fewer loops, as long as there is at least one loop.

Figure 3:
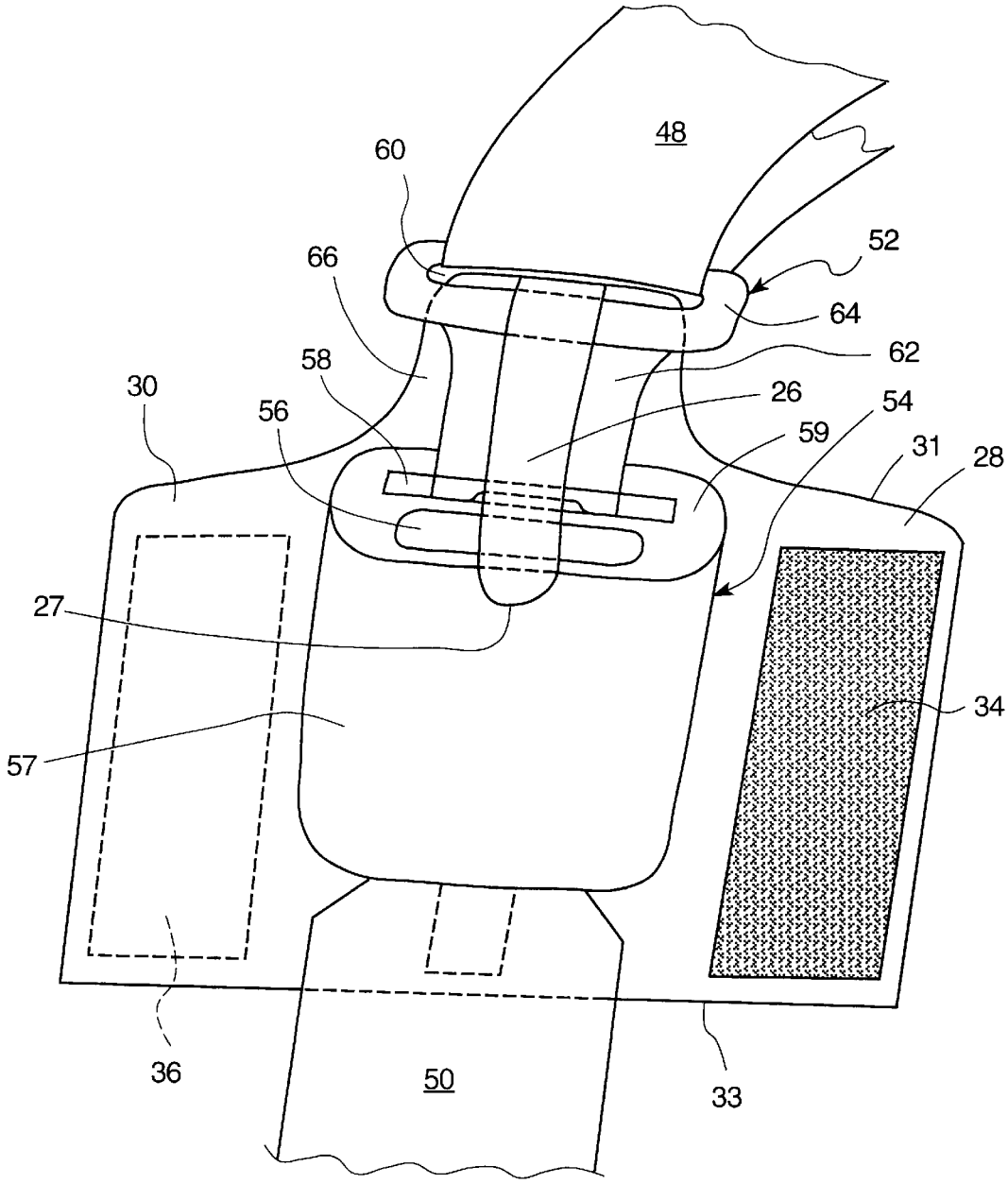
FIG. 3 shows a partially assembled view of a second embodiment of the present invention.

FIG. 3 shows the second embodiment of the buckle cover 22 partially assembled with a male buckle 52 and a female buckle 54. The male buckle 52 generally has a belt looper 64 with centrally located belt slot 60 and elongated tab 62 for insertion into the female buckle 54. The female buckle 54 has a body 57 with a release button 56 on the top 59 and adjacent engagement slot 58 for accepting and retaining the tab 62 of the male buckle 52.

FIG. 3 shows the tongue 26 partially inserted through the belt slot 60. This embodiment of the invention has an elongated neck 66 portion which is pulled through the belt slot 60 by the tongue 26.

When the male buckle 52 is fully engaged with the female buckle 54, the neck 66 is pulled as far as possible through the belt slot 60.

Figure 7:
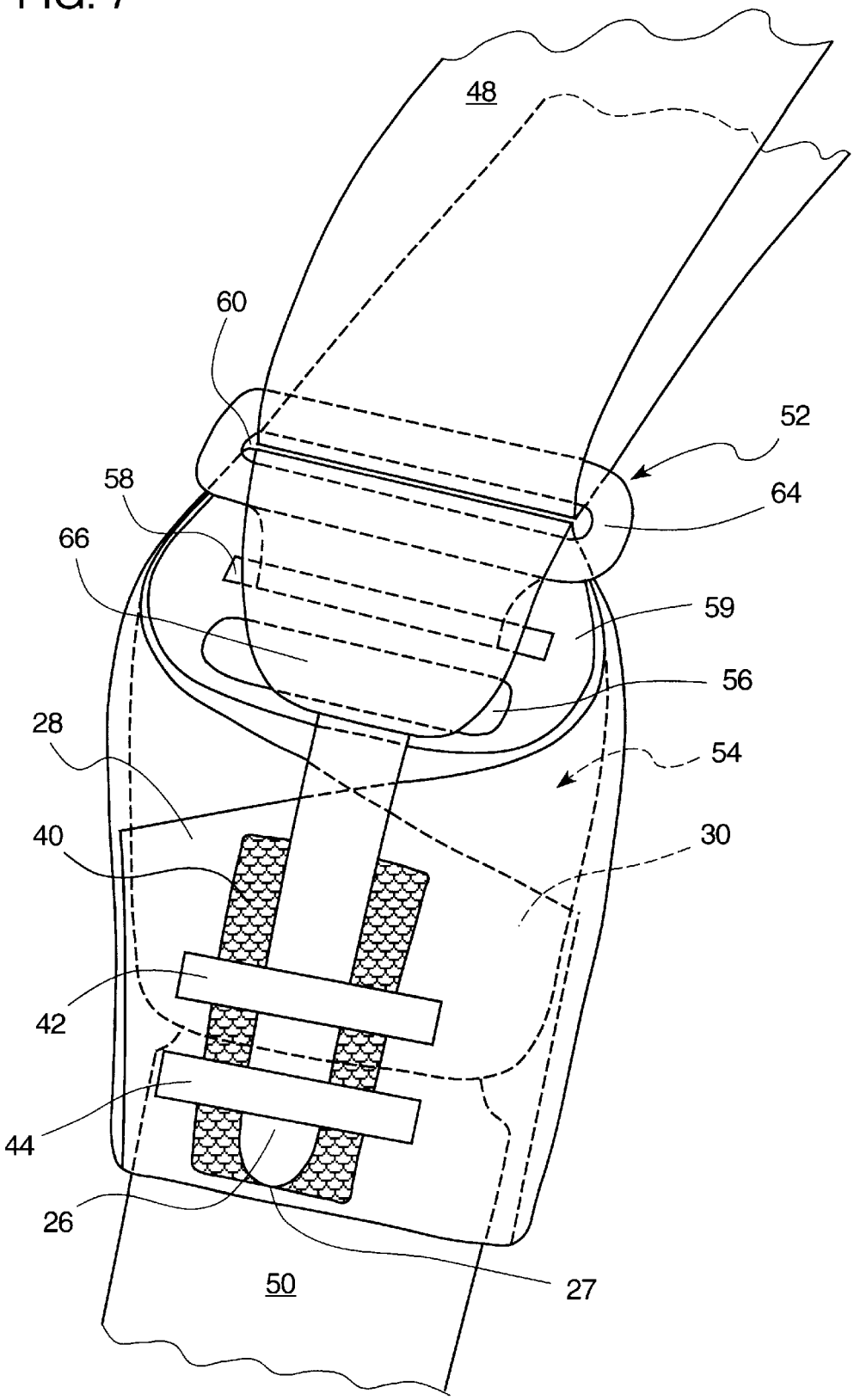
FIG. 7 shows the second embodiment assembled with a top release button seat belt buckle.

FIG. 7 shows the buckle cover 22 fully engaging the male buckle 52 which is fully engaged with the female buckle 54. In use, the inside surface 24 of the second side 30 is wrapped around the female buckle 54. The inside surface 24 of the first side 28 is then wrapped around the female buckle 54 and second side 30 such that the first fastener 34 engages the second fastener 36 and the buckle cover 22 is securely retained around the female buckle 54. Next, the tongue 26 is pulled through the belt slot 60 which in turn pulls the neck 66 through the belt slot 60.

The tongue 26 is then inserted beneath the loops 42, 44 where the fourth fastener 46 engages and is retained by the third fastener 40. The tongue 26 is thus quite difficult to remove from the third fastener 40. In order to remove the tongue 26, requires lifting the tongue 26 away from the third fastener 40 and elongating the loops 42, 44 as the tongue 26 is slid from beneath the loops 42, 44.

FIG. 7 also shows the first side 28 and second side 30 partially covering the top 59 of the female buckle 54. In this embodiment, neck 66 also partially covers the top 59 of female buckle 54. This prevents a rider from gaining access to the release button 56 and prematurely releasing the upper seat belt 48 from the lower seat belt 50. When the rider reaches down to push the release button 56, their hand is deflected away from the release button 56. The tension on the tongue 26 and neck 66 prevent the neck 66 from being pushed down onto the release button 56. Even if a rider can push on the neck 66, there is not enough slack in the tongue 26 and neck 66 to allow the release button 56 to be fully pushed to release the male buckle 52 from the female buckle 54.

Figure 4:
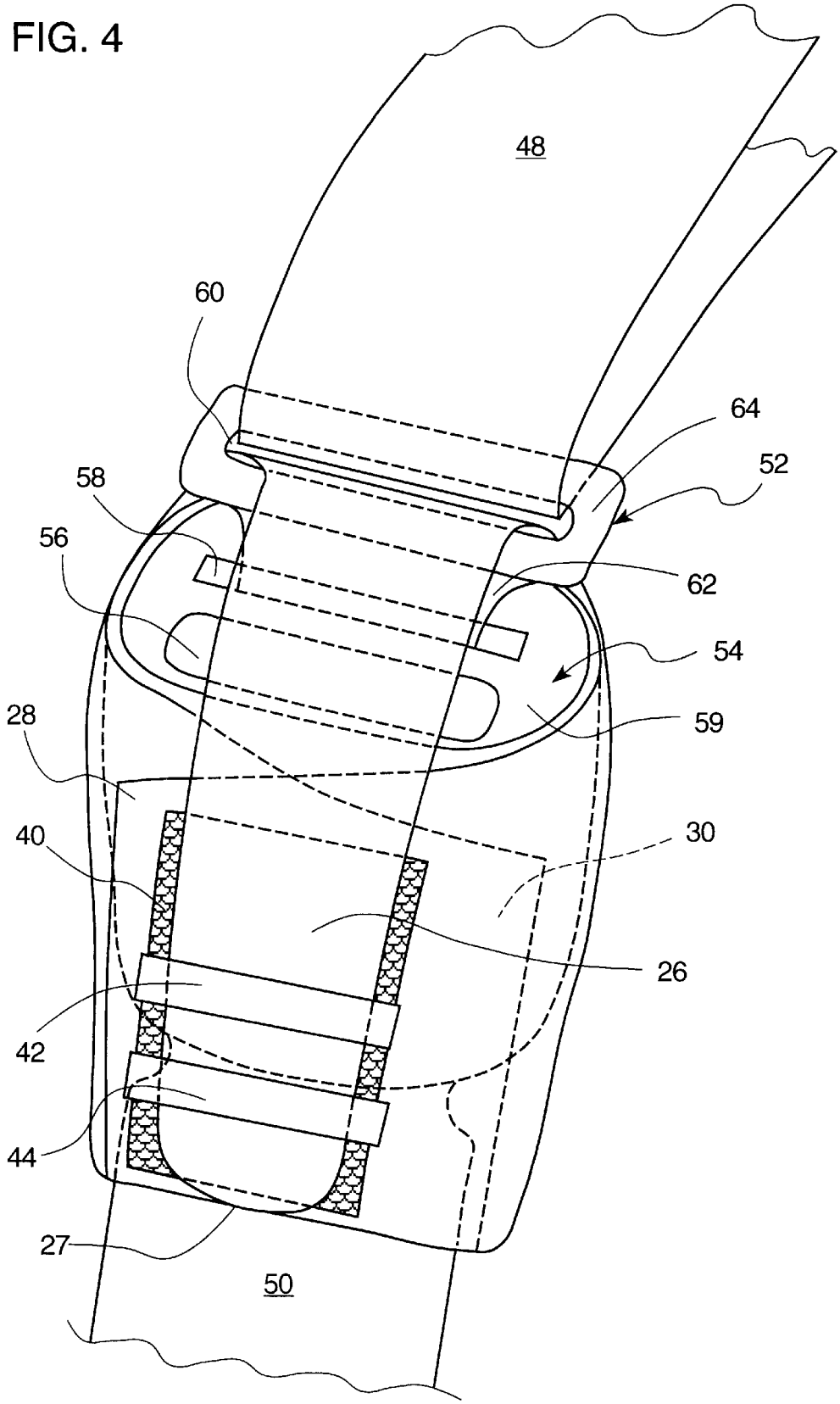
FIG. 4 shows a view of the first embodiment assembled with a top release button seat belt buckle.

FIG. 4 shows an alternative embodiment of the buckle cover 22 assembled to the male buckle 52 and female buckle 54. In this embodiment, the tongue 26 is of a width such that it fits through the belt slot 60, and yet provides maximum coverage to the release button 56. The width of the tongue 26 can be varied depending on the width of the belt slot 60 and the thickness of the tongue 26 is also governed by the belt slot 60 opening. FIG. 4 shows the tongue 26 having a width greater than the tongue 26 in FIGS. 1,2,3,5,6 and 7. The tongue 26 thereby prevents access to the release button 56 by deflecting the hand away from the release button 56. The tension in the tongue 26 prevents deformation of the tongue 26 thereby preventing depression of the release button 56. Hence the male buckle 52 cannot be prematurely released from the female buckle 54.

FIG. 4 also shows the first side 28 and second side 30 wrapped around the sides of the female buckle 54 and not covering the top 59. The installed position of the first side 28 and second side 30 relative to the female buckle 54, depends on the relative size of the female buckle 54 and the installation of the buckle cover 22 by the user.

Figure 5:
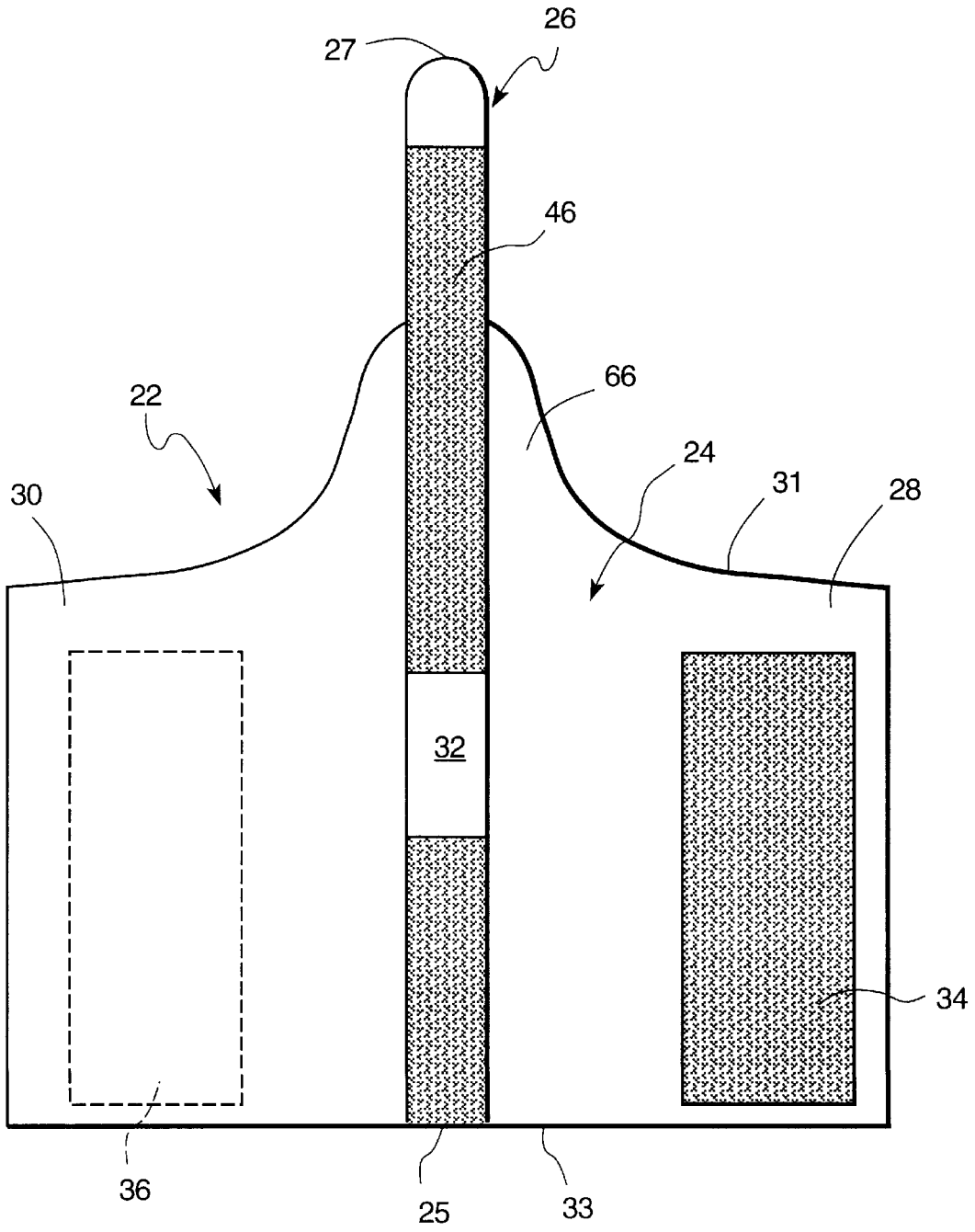
FIG. 5 shows a view of the second embodiment of the inside surface of the present invention.

FIG. 5 shows a second embodiment of the buckle cover 22 having the elongated neck 66 feature. FIG. 5 shows the inside surface 24 which is generally equivalent to the first embodiment shown in FIG. 1 with the exception of the neck 66 portion.

Figure 6:
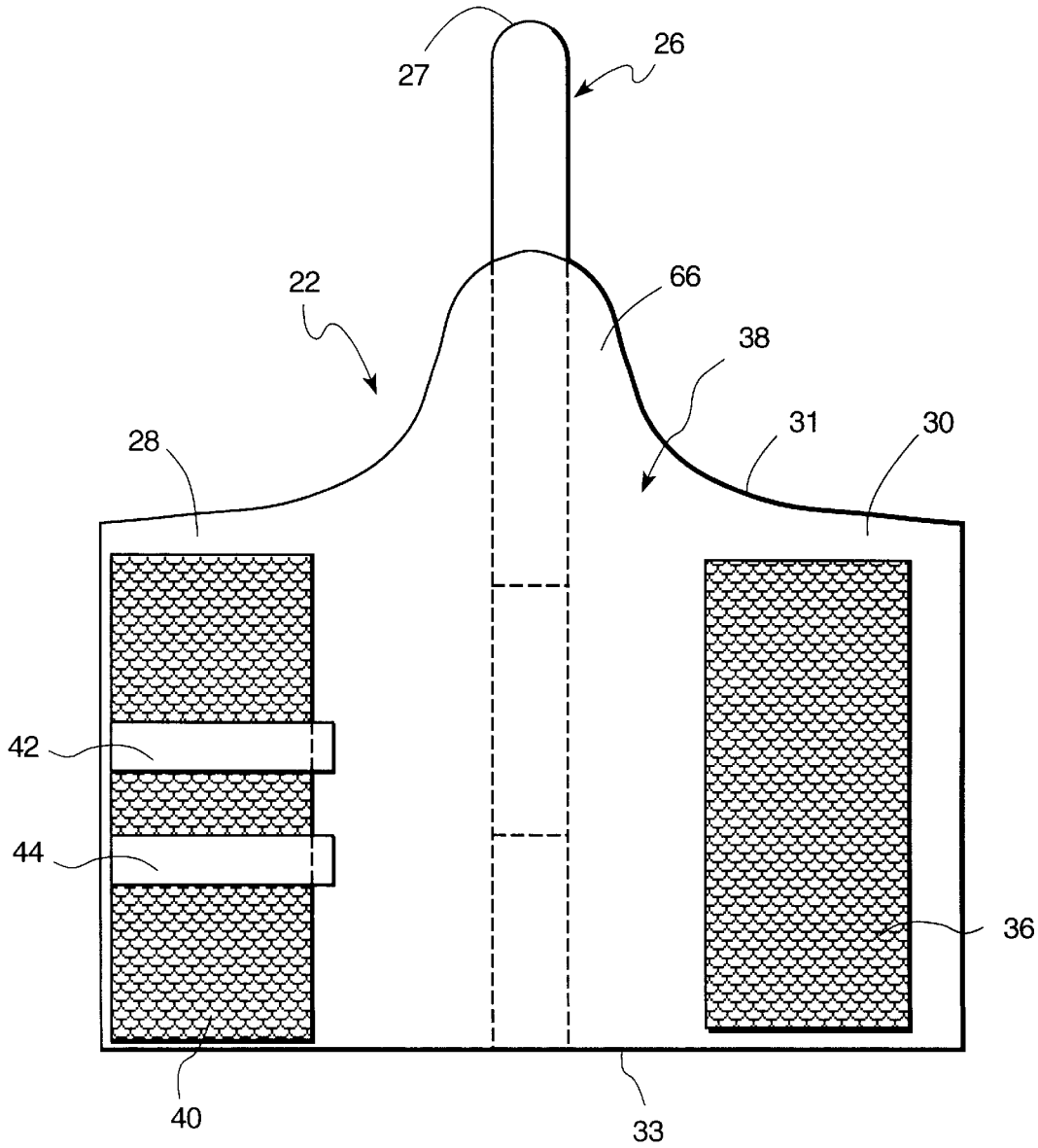
FIG. 6 shows a view of the second embodiment of the outside surface of the present invention.

FIG. 6 shows the second embodiment of the buckle cover 22 having the elongated neck 66. FIG. 6 shows the outside surface 38 which is generally equivalent to the first embodiment shown in FIG. 2 with exception of the neck 66 portion.

Connector 32, shown in FIGS. 1 and 5, is shown as a hook and loop fastener having an adhesive and backing. When the backing is removed, the connector 32 can be attached to the female buckle 54 to retain the buckle cover 22 to the female buckle 54. Therefore, when the buckle cover 22 is disengaged from the male buckle 52 and the male buckle 52 is released from the female buckle 54, the buckle cover 22 is retained to the female buckle 54. Other means for attachment of connector 32 to inside surface 24 could be utilized such as stitching, rivets or bonding.

The tongue 26 is not required to extend along the entire inside surface 24 of the buckle cover 22. Alternative embodiments are anticipated where the tongue 26 is attached near the top edge 31 with stitching, adhesive or other means whereby the connector 32 is a hook and loop fastener and is appropriately located and attached to the inside surface 24.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A seat belt buckle cover comprising:

a buckle cover made from flexible sheet material having an inside surface and an outside surface, a first side and a second side, a top edge and a bottom edge, a neck located approximately centrally between the first side and second side and extending from the top edge;

a flexible tongue connected to the inside surface approximately centrally between the first side and second side, a first end of the tongue extending from the neck and a fourth fastener affixed near the first end of the tongue;

a first fastener affixed to the inside surface of the first side;

a second fastener affixed to the outside surface of the second side for attachment to the first fastener;

a third fastener affixed to the outside surface of the first side for attachment to the fourth fastener;

at least one loop attached over the third fastener for retaining the tongue and fourth fastener to the third fastener.

2. The buckle cover of claim 1, wherein:

the neck is elongated and extends from the top edge.

3. The buckle cover of claim 1, further comprising:

a connector affixed to the inside surface and located between the first side and the second side.

4. The connector of claim 3, wherein:

the connector is a hook and loop fastener with an adhesive backing.

5. The buckle cover of claim 1, wherein:

the third fastener and the fourth fastener are hook and loop fasteners;

the first fastener and second fastener are hook and loop fasteners.

6. The buckle cover of claim 1, wherein:

the first, second and third fasteners are sewn to the buckle cover.

7. The buckle cover of claim, wherein:

the first, second and third fasteners are adhesively bonded to the buckle cover.

8. A seat belt buckle cover comprising:

a buckle cover of flexible sheet material having an inside surface, an outside surface, a first side and a second side, a top edge and a bottom edge;

a flexible tongue affixed to the inside surface, said tongue extending from an elongated neck, the elongated neck located between the first and second side, a fourth fastener connected to the tongue near a first end and a connector attached to the fourth fastener between the first end and a second end of the tongue;

a first fastener affixed to the inside surface of the first side;

a second fastener affixed to the outside surface of the second side for engaging the first fastener;

a third fastener affixed to the outside surface of the first side;

at least one loop attached over the third fastener for retaining the tongue and fourth fastener to the third fastener.

9. The buckle cover of claim 8, further comprising:

a connector affixed to the inside surface and located between the first side and the second side.

10. The connector of claim 9, wherein:

the connector is a hook and loop fastener with an adhesive backing.

11. The buckle cover of claim 8, wherein:

the third fastener and the fourth fastener are hook and loop fasteners;

the first fastener and second fastener are hook and loop fasteners.

12. The buckle cover of claim 8, wherein:

the first, second and third fasteners are adhesively bonded to the buckle cover.

13. The buckle cover of claim 8, wherein:

the first, second and third fasteners are sewn to the buckle cover.

14. A seat belt buckle cover to discourage the release of a seat belt buckle, the seat belt buckle having a male buckle and a female buckle with a release button on the female buckle, the seat belt buckle cover comprising:

a buckle cover of flexible sheet material having an inside surface, an outside surface, a first side and a second side, a top edge and a bottom edge, said inside surface for circumscribing the seat belt buckle;

a first fastener affixed to the inside surface of the first side, a second fastener affixed to the outside surface of the second side, said first side overlapping the second side such that the first and second fasteners are joined to retain the buckle cover securely against the seat belt buckle;

a flexible tongue connected to the inside surface extending from a neck, the neck located near the top edge; and a fourth fastener connected to the tongue near a first end of the tongue, said tongue inserted through the male buckle and over the release button, said tongue inserted through at least one loop attached over a third fastener, said loop to retain the fourth fastener to the third fastener, said third fastener located on the first side outside surface.

15. The buckle cover of claim 14, further comprising:

a connector affixed to the inside surface, said connector located between the first side and the second side, said connector for retaining the buckle cover to the seat belt buckle when the buckle cover is released.

16. The connector of claim 15, wherein:

the connector is a hook and loop fastener with an adhesive backing.

17. The buckle cover of claim 14, wherein:

the third fastener and the fourth fastener are hook and loop fasteners;

the first fastener and second fastener are hook and loop fasteners.

18. The buckle cover of claim 14, wherein:

the first, second and third fasteners are sewn to the buckle cover.

19. The buckle cover of claim 14, wherein:

the first, second and third fasteners are adhesively bonded to the buckle cover.

20. A seat belt buckle cover to discourage the release of a seat belt buckle, the seat belt buckle having a male buckle and a female buckle with a release button on the female buckle, the seat belt buckle cover comprising:

a buckle cover of flexible sheet material having an inside surface, an outside surface, a first side and a second side, a top edge and a bottom edge;

a first fastener affixed to the inside surface of the first side, a second fastener affixed to the outside surface of the second side, said first side overlapping the second side such that the first and second fasteners connect to retain the buckle cover securely against the belt buckle;

a flexible tongue affixed to the inside surface and extending from an elongated neck, the elongated neck located between the first side and second side; and a fourth fastener connected to the tongue near a first end, at least one flexible loop attached over a third fastener, said tongue and neck inserted through the male buckle and over the release button, said tongue inserted through at least one loop such that the fourth fastener attaches to the third fastener.

21. The buckle cover of claim 20, wherein:

the neck is elongated and extends from the top edge.

22. The buckle cover of claim 20, further comprising:

a connector affixed to the inside surface located between the first side and the second side, said connector for retaining the buckle cover to the seat belt buckle when the buckle cover is released.

23. The connector of claim 22, wherein:

the connector is a hook and loop fastener with an adhesive backing.

24. The buckle cover of claim 20, wherein:

the third fastener and the fourth fastener are hook and loop fasteners;

the first fastener and second fastener are hook and loop fasteners.

25. The buckle cover of claim 20, wherein:

the first, second and third fasteners are sewn to the buckle cover.

26. The buckle cover of claim 20, wherein:

the first, second and third fasteners are adhesively bonded to the buckle cover.

* * * * *